US005685638A

United States Patent [19]

Huang

[11] Patent Number: 5,685,638

[45] Date of Patent: Nov. 11, 1997

[54] WATERPROOF STRUCTURE FOR A DECORATIVE LIGHT

[76] Inventor: Chin-wang Huang, No. 26, Alley 26, Lane 108, Sec. 1, Kwangfu Rd., Hsinchu, Taiwan

[21] Appl. No.: 661,400

[22] Filed: Jun. 7, 1996

[51] Int. Cl.[6] ..... F21V 31/00

[52] U.S. Cl. ..... 362/267; 362/226; 362/806; 313/318.09; 439/280; 439/356

[58] Field of Search ..... 362/158, 226, 362/249, 267, 806; 439/278, 280, 281, 356, 702, 707; 313/318.01, 318.05, 318.09, 318.1

[56] References Cited

U.S. PATENT DOCUMENTS

| | | | |
|---|---|---|---|
| 816,483 | 3/1906 | Leonard et al. | 439/280 |
| 3,660,800 | 5/1972 | Detch | 439/280 |
| 4,100,448 | 7/1978 | Chipner et al. | 362/267 |
| 4,432,046 | 2/1984 | Palsson | 362/267 |
| 4,679,126 | 7/1987 | Van Sickler | 362/226 |
| 4,999,751 | 3/1991 | Chen | 362/226 |
| 5,435,741 | 7/1995 | Wang | 439/356 |

*Primary Examiner*—Alan Cariaso
*Attorney, Agent, or Firm*—Jones, Day, Reavis & Pogue

[57] ABSTRACT

A decorative light consists of a sleeve defining a lower rectangular opening and an upper socket, a base received in the sleeve and defining two bottom holes and an upper socket, a bulb having a lower portion received in the socket of the base and two leads extending through the bottom holes of the base to be in contact with two contacts fixedly attached on an inside of the sleeve defining the lower rectangular opening, and a waterproof ring having an upper portion hermetically engaging with the bulb and a lower portion hermetically engaging with the sleeve.

10 Claims, 4 Drawing Sheets

WATERPROOF STRUCTURE FOR A DECORATIVE LIGHT

FIELD OF THE INVENTION

The present invention relates to a decorative light, particularly to a Christmas light which is waterproof.

BACKGROUND OF THE INVENTION

Referring to FIGS. 5 and 6 which show respectively in a perspective exploded view and a sectional view a conventional decorative light 90. The conventional decorative light 90 consists of a bulb 92 having two conductive leads 922 and 924, a base 94 having a wall 942 defining two bottom holes 944, 946 separated by a partition 945 and an upper socket 948 and a sleeve 96 having a wall 962 defining a lower rectangular opening 964 and an upper socket 966. Two strip metal contacts 967, 968 are oppositely and fixedly attached on an inside of the wall 962 of the sleeve 96 defining the rectangular opening 964. Furthermore, two electrical wires 100, 102 are respectively connected with the contacts 967, 968 so that the light 90 can be electrically connected with an electrical power source.

When assembling the conventional light 90, firstly the bulb 92 is brought to be attached to the base 94 by inserting a lower portion of the bulb 92 into the upper socket 948 of the base 94 and extending the leads 922, 924 of the bulb 92 through respectively the bottom holes 944, 946 of the base 94, in which a lower portion of the leads 922, 924 is extended beyond a bottom end of the base 94 a predetermined length. Then, the lower portion of the leads 922, 924 is bent sideways and upwardly against an outside of the wall 942 of the base 94 defining the bottom holes 944, 946. Finally, the bulb 92 together with the base 94 is assembled with the sleeve 96 by inserting the base 94 into the sleeve 96 in which the wall 942 of the base 94 defining the bottom holes 944, 946 is received in the rectangular opening 964, the wall 942 of the base 94 defining the upper socket 948 is received in the upper socket 966 of the sleeve 96 and the lower portion of the leads 922, 924 is contacted with the contacts 967, 968.

Although the above disclosed conventional decorative light 90 has a relatively few parts and can be assembled very easily and quickly, it has a significant defect that it is not waterproof. Water can enter and accumulate in the rectangular opening 964 of the sleeve 96 in which the leads 922, 924 of the bulb 92 are contacted with the contacts 967, 968 through the gaps between the bulb 92 and the base 94 as indicated by mark "A" and between the base 94 and the sleeve 96 as indicated by mark "B" in FIG. 6. Such a defect can greatly affect the usable life of the bulb 92 since the water entering and accumulating in the rectangular opening 964 may cause a short circuit of the leads 922, 924 of the bulb 92 which, in turn, may cause a filament of the bulb 92 to burn out. This situation occurs particularly when the decorative light 90 is used outdoors wherein rainwater falling on the decorative light 90 is unavoidable.

The present invention therefore is aimed to provide an improved waterproof structure for a decorative light to mitigate and/or obviate the aforementioned problems concerning the conventional decorative light.

SUMMARY OF THE INVENTION

One object of the present invention is to provide a decorative light which can effectively achieve a waterproof function.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
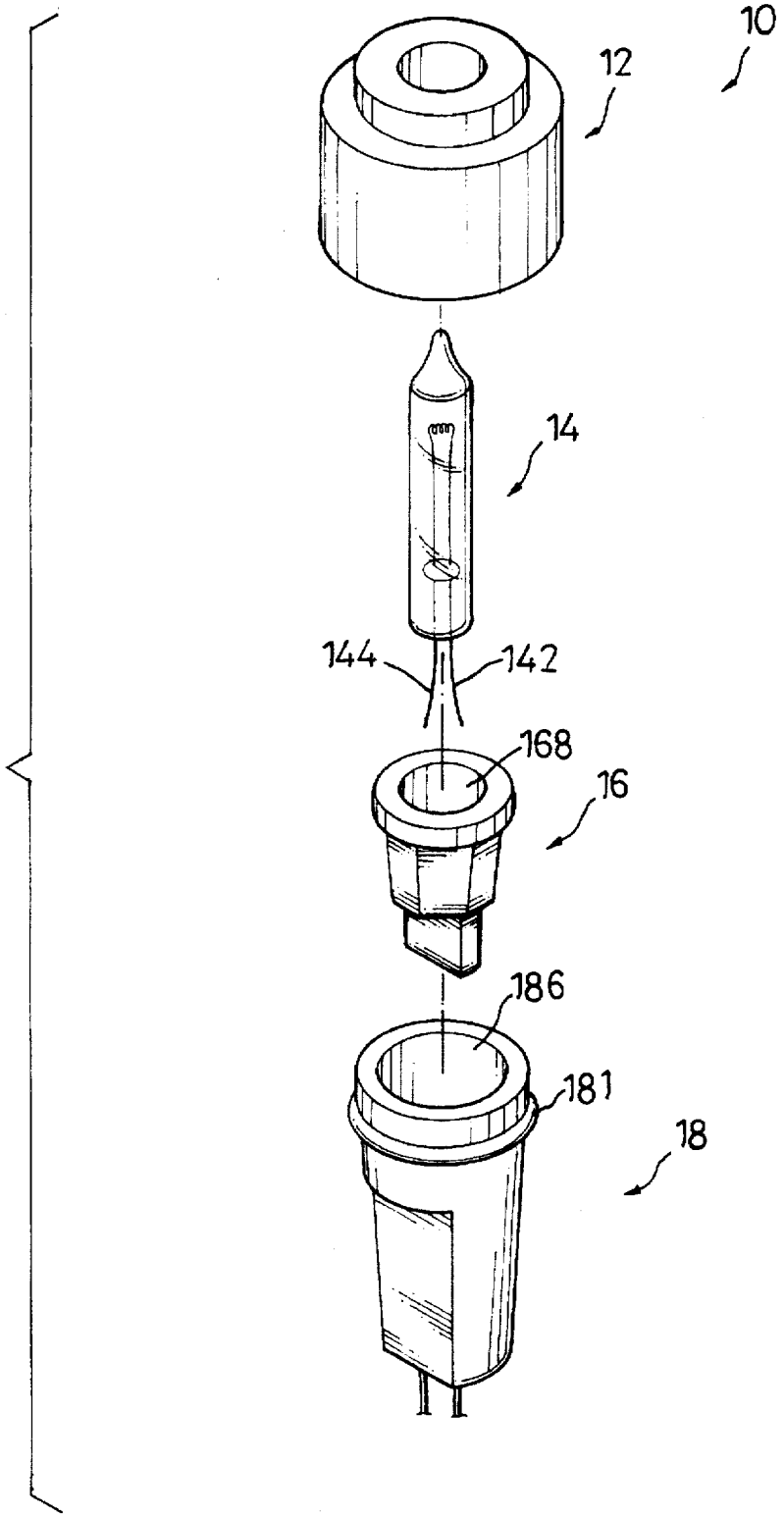
FIG. 1 is a perspective, exploded view of a decorative light in accordance with a first embodiment of the present invention.
Figure 2:
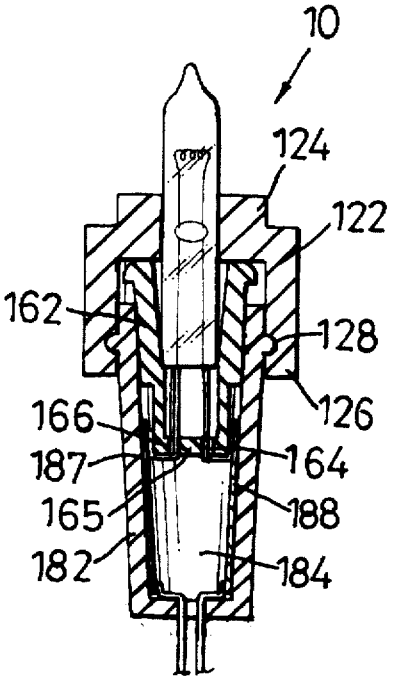
FIG. 2 is a cross-sectional view showing the decorative light of FIG. 1 in an assembled condition.
Figure 6:
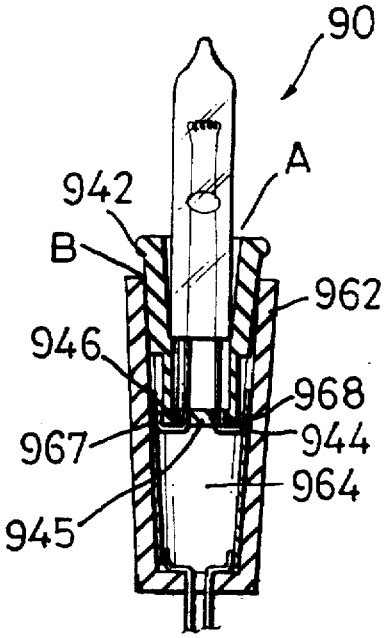
FIG 6 PRIOR ART
FIG. 6 is a cross-sectional view showing the decorative light of FIG. 5 in an assembled condition.

Referring to FIGS. 1 and 2, a first embodiment of a waterproof decorative light in accordance with the present invention is generally indicated by reference number 10. The decorative light 10 mainly consists of a waterproof ring 12, a bulb 14, a base 16 and a sleeve 18 wherein each of the bulb 14 and base 16 has a configuration the same as that of the bulb 92 and base 94 of the conventional decorative light 90. The sleeve 18 generally also has a configuration like that of the sleeve 96 of the conventional decorative light 90; however, a protrusion 181 is additionally formed on a wall 182 of the sleeve 18 defining an upper socket 186. The waterproof ring 12 has a wall 122 defining an upper portion 124 and a lower portion 126 wherein the upper portion 124 has an outer and inner diameter both smaller than those of the lower portion 126. The inner diameter of the upper portion 124 of the waterproof ring 12 is slightly smaller than an outer diameter of the bulb 14. Generally, the inner diameter of the upper portion 124 of the waterproof ring 12 has a dimension which is about 20 to 50 μm less than that of the outer diameter of the bulb 14. Preferably, the inner diameter of the upper portion 124 of the waterproof ring 12 is 20 μm less than the outer diameter of the bulb 14. The inner diameter of the lower portion 126 of the waterproof ring 12 has a dimension which is substantially the same as that of an outer diameter of the wall 182 of the sleeve 18 defining the upper socket 186. A groove 128 is formed on an inside of the wall 122 of the waterproof ring 12 defining the lower portion 126. The groove 128 has a configuration and dimension substantially corresponding to those of the protrusion 181 formed on the sleeve 18. The base 16 and sleeve 18 of the present invention are formed of a material like that forming the base 94 and sleeve 96 of the conventional decorative light 90, i.e., plastic. The waterproof ring 12 is formed of a heat-resistant elastomer, for example, silicone rubber.

When assembling the decorative light 10 in accordance with the present invention, firstly, like the process when assembling the conventional decorative light 10, the bulb 14 is brought to be attached to the base 16 by inserting a lower portion of the bulb 14 into an upper socket 168 defined by a wall 162 of the base 16 and extending two leads 142, 144 of the bulb 14 through respectively two bottom holes 164, 166 defined by the wall 162 and a partition 165 of the base 16 in which a lower portion of the leads 142, 144 is extended beyond a bottom end of the base 16 a predetermined length. Then, the lower portion of the leads 142, 144 is bent sideways and upwardly against an outside of the wall 162 of the base 16 defining the bottom holes 164, 166. Thereafter, the bulb 14 together with the base 16 is assembled with the sleeve 18 by inserting the base 16 into the sleeve 18 in which the wall 162 of the base 16 defining the bottom holes 164, 166 is received in a lower rectangular opening 184 defined by the wall 182 of the sleeve 18, the wall 162 of the base 16 defining the upper socket 168 is received in the upper socket 186 of the sleeve 18 and the lower portion of each of the leads 142, 144 is respectively contacted with two contacts 187, 188 which are fixedly attached to an inside of the wall 182 defining the rectangular opening 184. Finally, to provide the decorative light 10 with a waterproof function, the waterproof ring 12 is assembled to the assembled bulb 14, base 16 and sleeve 18 by extending the waterproof ring 12 over and onto the bulb 14, base 16 and sleeve 18 to reach a position as shown by FIG. 2, in which the lower portion 126 of the waterproof ring 12 engages with the wall 182 of the sleeve 18 defining the upper socket 186, the groove 128 hermetically engages with the protrusion 181 and the upper portion 124 of the waterproof ring 12 hermetically engages with the bulb 14.

Since the gaps between the bulb 14 and the wall 162 of the base 16 defining the upper socket 168 and between the base 16 and the wall 182 of the sleeve 18 defining the upper socket 186 in the present invention are sealed by the hermetical engagement between the groove 128 and the protrusion 181 and between the upper portion 124 of the waterproof ring 12 and the bulb 14, thus, when water falls on the decorative light 10, it is prevented from entering and accumulating in the rectangular opening 184 through these gaps. Thus, the decorative light 10 in accordance with the present invention can achieve the waterproof function.

Figure 4:
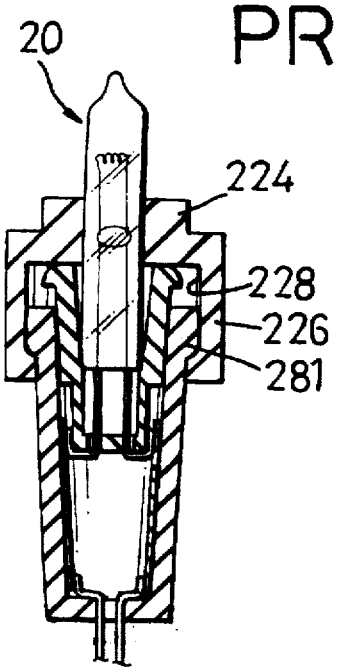
FIG. 4 is a cross-sectional view showing the decorative light of FIG. 3 in an assembled condition.
Figure 3:
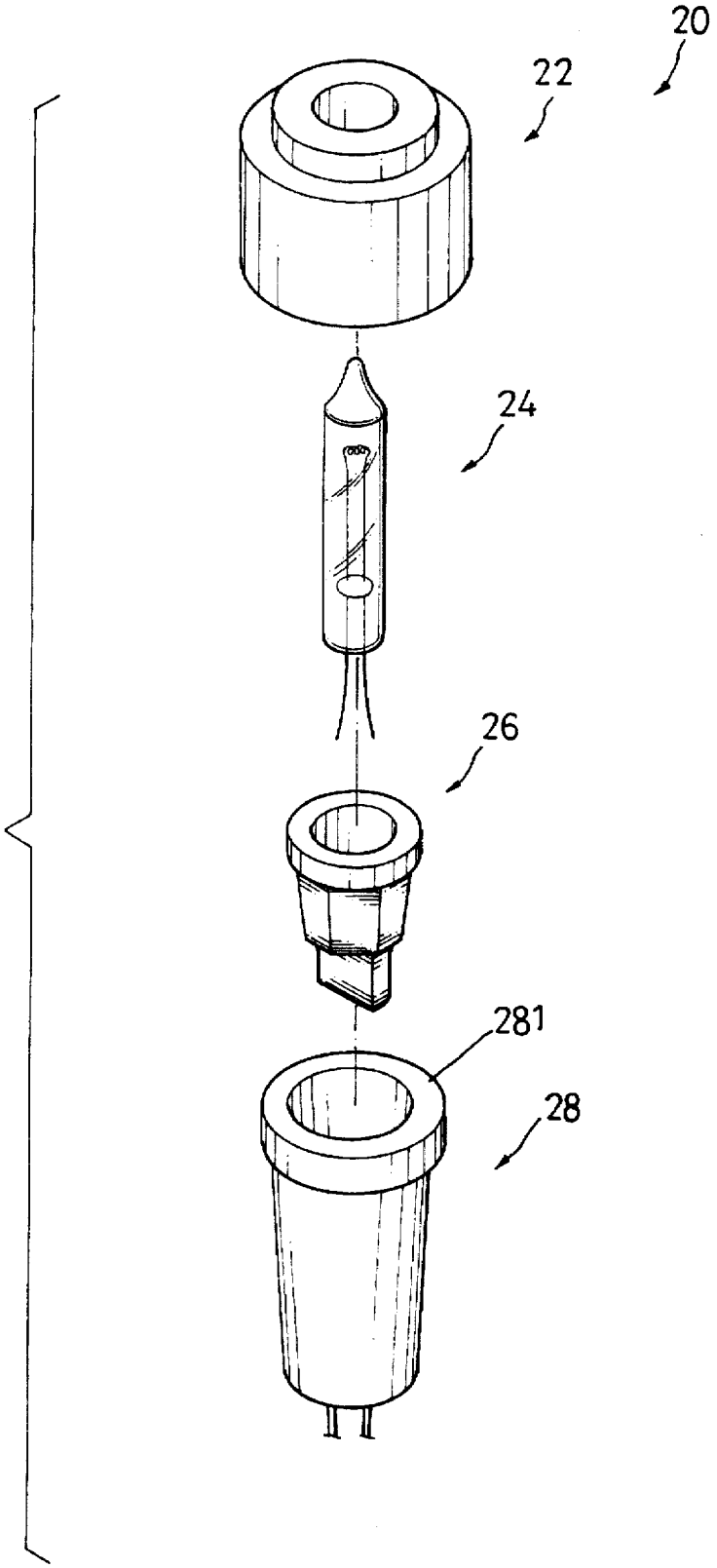
FIG. 3 is a perspective, exploded view of a decorative light in accordance with a second embodiment of the present invention.
Figure 5:
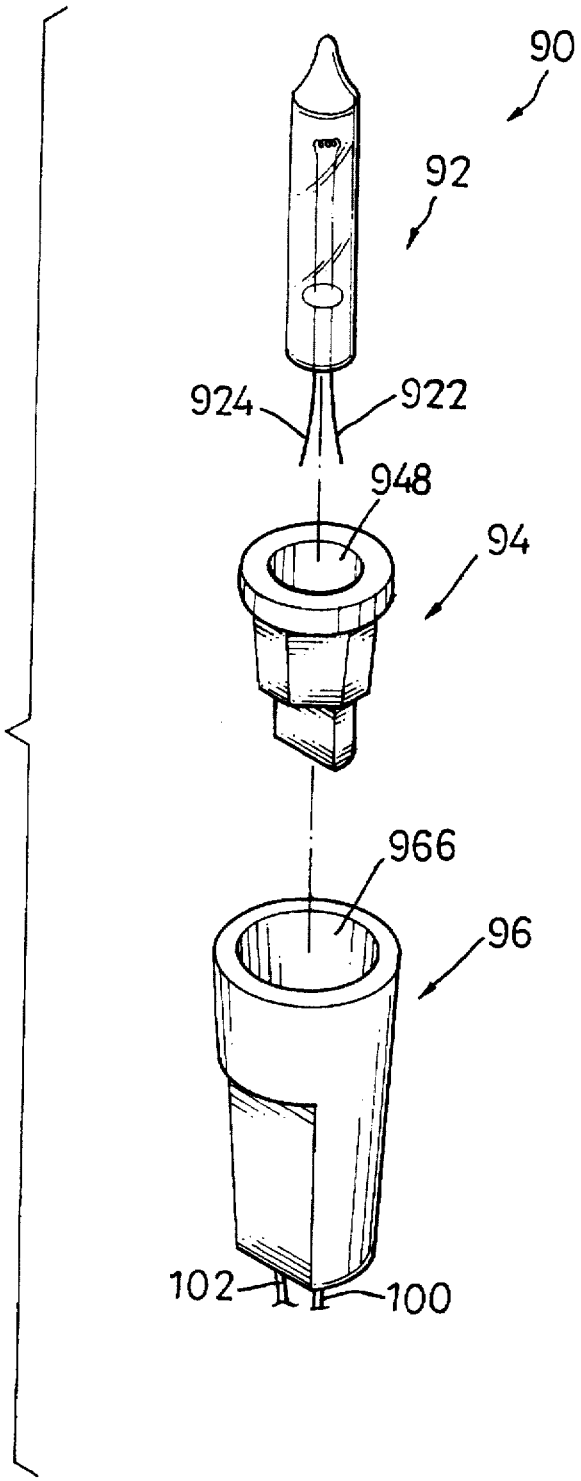
FIG. 5 PRIOR ART
FIG. 5 is a perspective, exploded view showing a conventional decorative light.

FIGS. 3 and 4 show a second embodiment of a decorative light in accordance with the present invention which is generally indicated by reference number 20.

The decorative light 20, like the decorative light 10, also consists of a waterproof ring 22, a bulb 24, a base 26 and a sleeve 28. Each of the bulb 24 and the base 26 has a configuration the same as that of the bulb 92 and base 94 of the conventional decorative light 90 and the bulb 14 and base 16 of the decorative light 10 in accordance with the first embodiment of the present invention. Each of the waterproof ring 22 and sleeve 28 has a configuration a little different from that of the waterproof ring 12 and sleeve 18 of the first embodiment.

Instead of the protrusion 181 of the first embodiment, the sleeve 28 in accordance with the second embodiment of the present invention is formed with a flange 281 at a top thereof. Furthermore, instead of the groove 128 of the first embodiment, the waterproof ring 22 in accordance with the second embodiment of the present invention is formed with a recess 228 at an inside of a lower portion 226 of the waterproof ring 22.

The manner to assemble the bulb 24, base 26 and sleeve 28 is the same as that to assemble the bulb 14, base 16 and sleeve 18. After the bulb 24, base 26 and sleeve 28 are assembled together, then the waterproof ring 22 is assembled thereto by extending the waterproof ring 22 over and onto the bulb 24, base 26 and sleeve 28 to reach a position as shown by FIG. 4, in which an upper portion 224 of the waterproof ring 22 hermetically engages with the bulb 24 and the lower portion 226 of the waterproof ring 22 defining the recess 228 having a lower part hermetically engaging with the top flange 281 formed on the sleeve 28.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A decorative light, comprising:

a sleeve having a wall defining an upper socket and a lower opening;

two contacts fixedly attached on an inside of the wall of the sleeve defining the lower opening;

a base having a wall defining an upper socket and two bottom holes wherein the wall of the base defining the upper socket thereof is received in the upper socket of the sleeve and the wall of the base defining the bottom holes is received in the lower opening of the sleeve;

a bulb having a lower portion received in the upper socket of the base and two leads extending through the bottom holes to contact with the contacts; and a waterproof ring having an upper portion hermetically engaging with the bulb and a lower portion hermetically engaging with the sleeve.

2. The decorative light in accordance with claim 1 wherein the hermetical engagement between the lower portion of the waterproof ring and the sleeve is achieved by means of an engagement between a protrusion and a groove.

3. The decorative light in accordance with claim 2 wherein the protrusion is provided on the wall of the sleeve.

4. The decorative light in accordance with claim 2 wherein the protrusion is provided on the wall of the sleeve defining the upper socket thereof.

5. The decorative light in accordance with claim 1, wherein the waterproof ring is made of heatresistant elastomer.

6. The decorative light in accordance with claim 5 wherein the waterproof ring is made of silicone rubber.

7. The decorative light in accordance with claim 5, wherein the upper portion of the waterproof ring has an inner diameter which is slightly smaller than an outer diameter of the bulb.

8. The decorative light in accordance with claim 7, wherein the inner diameter of the upper portion of the waterproof ring is about 20 to 50 μm less than the outer diameter of the bulb.

9. The decorative light in accordance with claim 8, wherein the inner diameter of the upper portion of the waterproof ring is about 20 μm less than the outer diameter of the bulb.

10. The decorative light in accordance with claim 1 wherein the hermetical engagement between the lower portion of the waterproof ring and the sleeve is achieved by means of an engagement between a recess defined by the lower portion of the waterproof ring and a flange defined at a top of the sleeve.

* * * * *